US007941973B2

(12) United States Patent
Tarrega Lloret

(10) Patent No.: US 7,941,973 B2
(45) Date of Patent: May 17, 2011

(54) SYNCHRONIZED ACTUATION SYSTEM FOR SLIDING DOORS

(75) Inventor: Miguel Angel Tarrega Lloret, Barcelona (ES)

(73) Assignee: Klein Iberica, S.A., Barcelona (ES)

( * ) Notice: Subject to any disclaimer, the term of this patent is extended or adjusted under 35 U.S.C. 154(b) by 470 days.

(21) Appl. No.: 11/946,501

(22) Filed: Nov. 28, 2007

(65) Prior Publication Data

US 2009/0173010 A1 Jul. 9, 2009

(30) Foreign Application Priority Data

Nov. 28, 2006 (ES) ..... 200603038

(51) Int. Cl.
*E05D 13/00* (2006.01)

(52) U.S. Cl. ..... 49/409; 49/116; 49/425

(58) Field of Classification Search ..... 49/116, 49/123, 409, 425
See application file for complete search history.

(56) References Cited

U.S. PATENT DOCUMENTS

| | | | | |
|---|---|---|---|---|
| 4,475,312 | A * | 10/1984 | Deutschle | 49/360 |
| 5,450,693 | A | 9/1995 | Tarrega | |
| 6,698,138 | B1 * | 3/2004 | Lin | 49/409 |
| 7,290,369 | B2 | 11/2007 | Tarrega Lloret | |
| 2005/0160672 | A1 * | 7/2005 | Tarrega Lloret | 49/118 |
| 2007/0062121 | A1 | 3/2007 | Tarrega Lloret | |

FOREIGN PATENT DOCUMENTS

| | | | |
|---|---|---|---|
| DE | 32 38 204 | | 4/1984 |
| DE | 3602567 | A1 * | 7/1987 |
| DE | 38 00 444 | | 7/1989 |
| EP | 1 544 399 | | 6/2005 |
| ES | 2 084 543 | | 5/1996 |
| ES | 2 246 673 | | 2/2006 |
| ES | 2 293 795 | | 3/2008 |
| JP | 04011186 | A * | 1/1992 |

* cited by examiner

*Primary Examiner* — Jerry Redman
(74) *Attorney, Agent, or Firm* — Merchant & Gould P.C.

(57) ABSTRACT

A synchronized actuation system for sliding doors, of the type of those formed, in which the pulling grip (1) and the free grip (2) have flanges (12) and the belt (4) and free (2) and pulling (1) grips are joined by a connecting shoe (3). With this configuration it is possible to carry out assembly and maintenance operations vertically and therefore in situ.

1 Claim, 3 Drawing Sheets

SYNCHRONIZED ACTUATION SYSTEM FOR SLIDING DOORS

OBJECT OF THE INVENTION

The object of this specification is to perfect and improve synchronized actuation systems for sliding doors, consisting of the use of a connecting shoe in the synchronic actuation mechanism.

The invention is especially suitable to be applied to sliding doors, which can move with respect to fixed panels framing the practicable passage area assisted by said doors.

BACKGROUND OF THE INVENTION

The applicant is the proprietor of invention patent ES 2246673, the object of which is to present a device for the synchronized actuation of sliding doors with two connecting grips and their corresponding connection parts. The applicant is also the proprietor of invention patent ES 2293795, a mechanism for a sliding glass leaf, in which the suspension grip of the sliding door is improved.

Nevertheless, in both systems, the access to the internal components of the mechanism (suspension device) is carried out through a lid consisting of a gallery profile, and always horizontally. This arrangement of the elements makes it necessary to always leave a clearance allowing the installation of the system and future maintenance such as, for example, adjustments, substitution of parts, etc.

SUMMARY OF THE INVENTION

The improved synchronized actuation system for sliding doors, object of this invention patent, is designed to palliate, or where appropriate, eliminate the technical drawbacks considered.

The introduced improvement consists of the use of a connecting shoe joined to the pulling grip or suspension device by means of screws. The suspension devices have also been modified with respect to that claimed in the main patent so as to provide it with a flange and holes suitable joining it to the connecting shoe.

The operation of the invention is as follows. The grips holding the door, both the pulling grip and the free grip (both are suspension devices), are first centered. Once the grips are in place, the connecting shoe is fixed to the pulling grip. To that end, the connecting shoe is moved along the transmission belt, until the holes of the shoe are opposite to the holes of the pulling grip, both elements being fixed by screws. Finally, the suspension device—connecting shoe assembly is fixed to the transmission belt by means of screws, each of them being fixed between two teeth of the mentioned belt.

The following advantages are obtained with respect to the arrangement used in the current state of the art by means of using the connecting shoe:

- Access to the suspension device can be carried out vertically, the horizontal clearance disappears, the system becoming more compact and multipurpose because it allows installation in any place.
- Any handling, either due to repair or due to assembly, is simplified with respect to that claimed in the main patent.

BRIEF DESCRIPTION OF THE DRAWINGS

A series of drawings is very briefly described below, which aid in better understanding the invention and are expressly related to an embodiment of said invention, presented as a non-limiting example thereof.

DETAILED DESCRIPTION OF THE PREFERRED EMBODIMENT(S)

Figure 1:
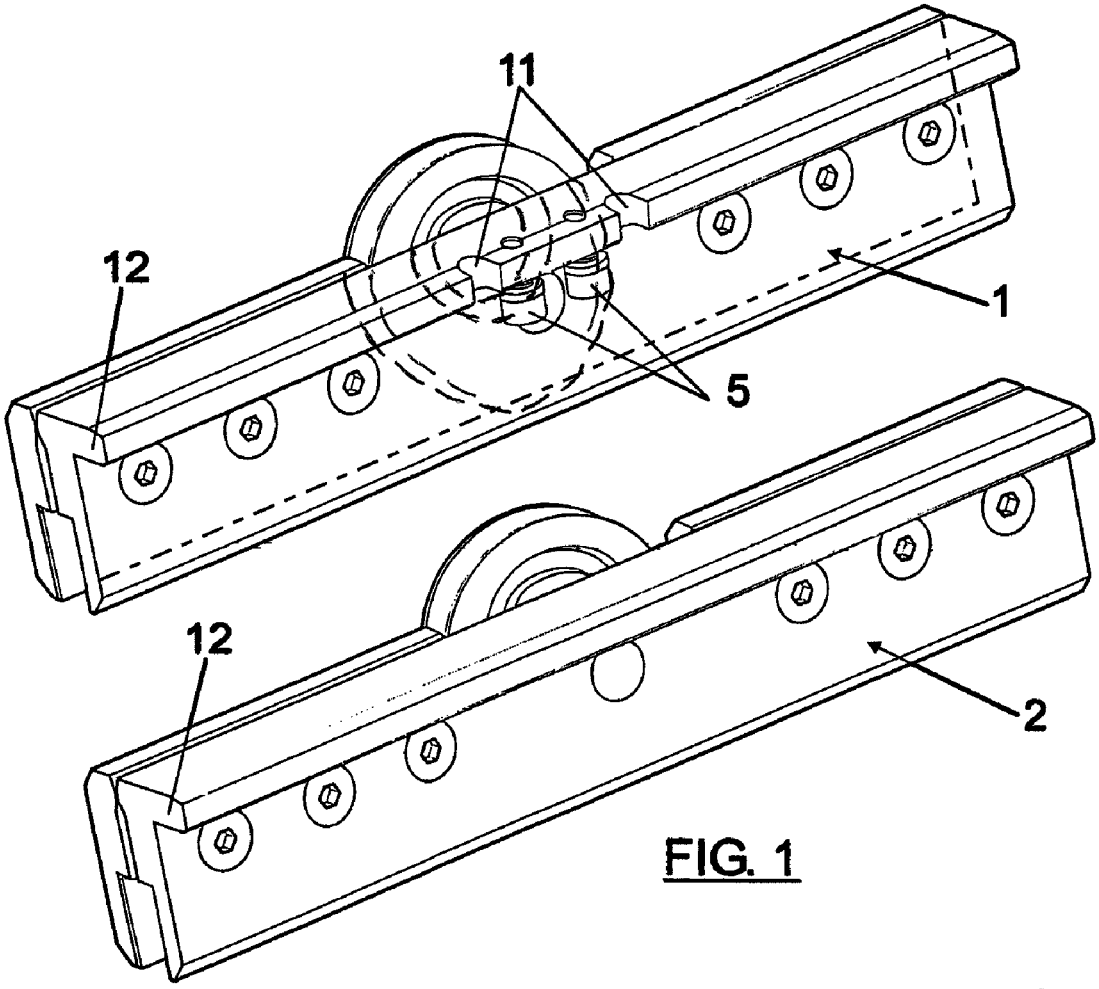
FIG. 1 is a view of the free and pulling grips integrating the actuation system object of this invention patent.

As can be observed in the attached figures, both the pulling grip (1) and the free grip (2) have been modified, with respect to the main patent, with flanges (12). Holes (11) suitable for the passage of the screws (32) for the joining between the shoe (3) and the transmission belt (4) have been made in the pulling grip (1) in the flange (12). In the same manner, there are two screws (5) for the joining between the shoe (3) and pulling grip (1) in the pulling grip (1).

Figure 2:
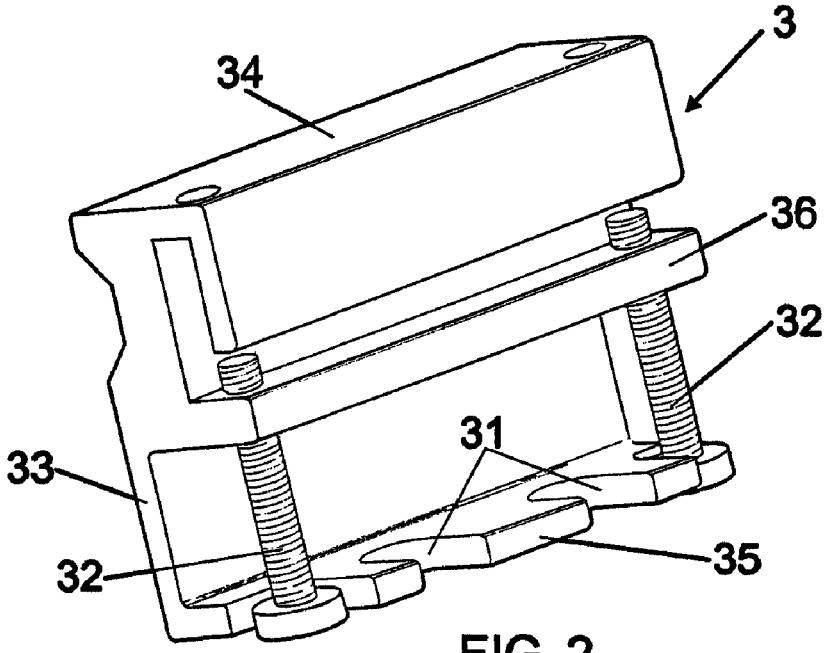
FIG. 2 is a view of the connecting shoe.

The formation of the connecting shoe (3) can be observed in FIG. 2. Describing it from its lower part to its upper part, the connecting shoe (3) is formed by a base (35) in which the holes (31) for the joining with the pulling grip (1) are made and from which respective screws (32) for the joining with the belt (4) emerge. A wall (33) extends vertically from the base, from which wall there emerges in turn an upper cover (34), leaving a gap through which the belt (4) will pass and be trapped by the screws (32) between this cover (34) and an intermediate base (35).

Figure 3:
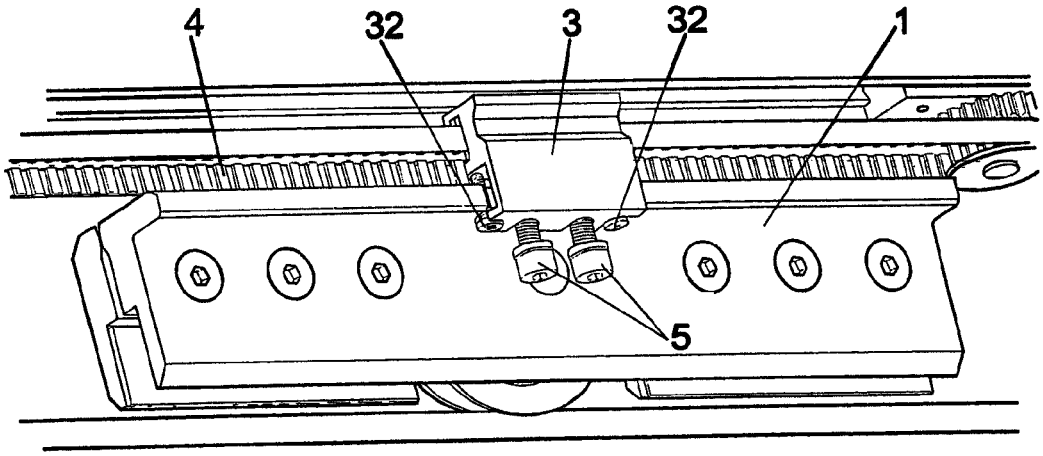
FIG. 3 is a view of the connecting shoe joined to the pulling grip and to the transmission belt.

FIG. 3 shows how the connecting shoe (3) is joined to the transmission belt (4) in the pulling grip (1) and how the latter rests on the guide (6) thanks to the wheel of the pulling grip (1).

Figure 4:
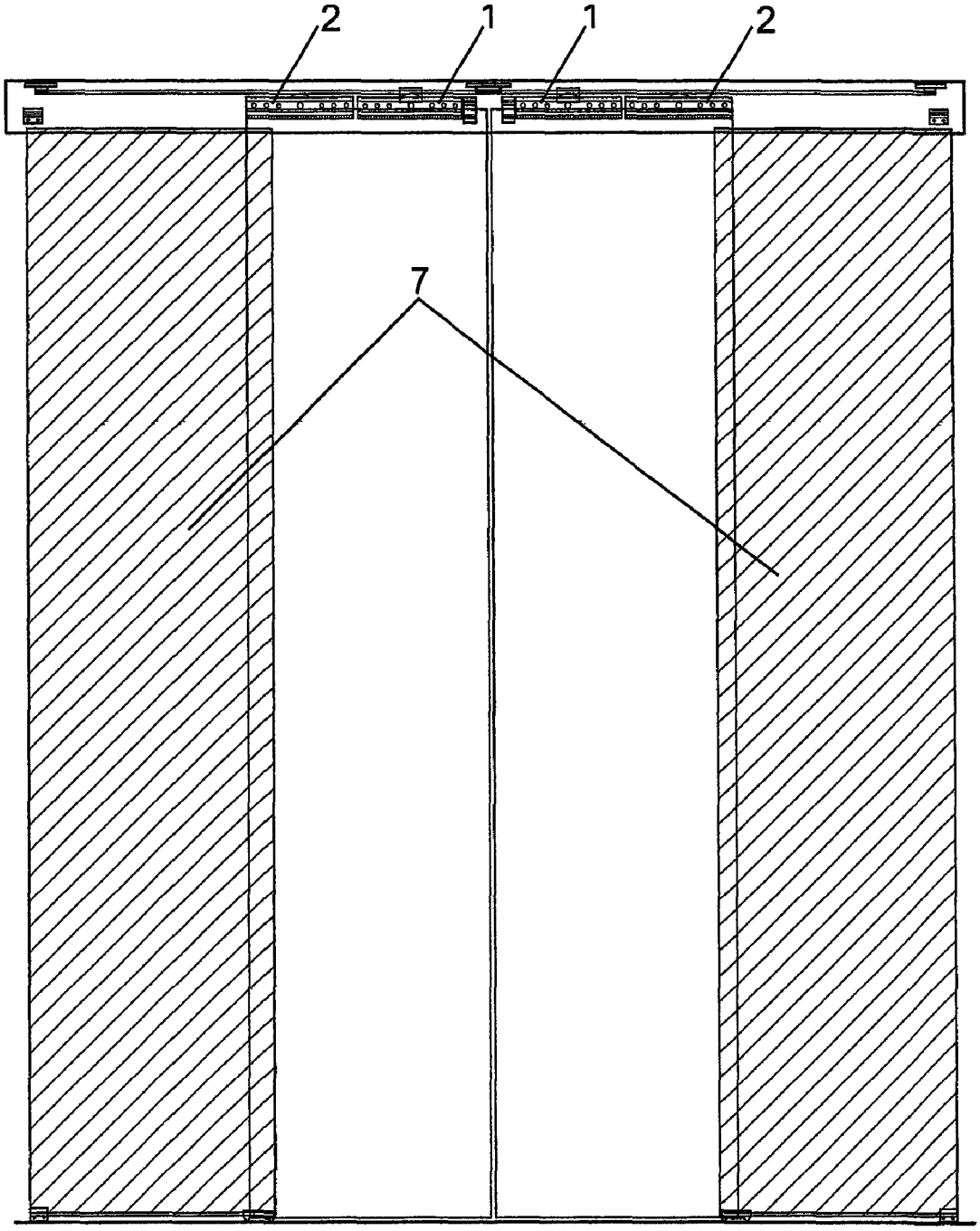
FIG. 4 is a view of the actuation system assembled in respective sliding doors.

FIG. 4 shows the assembly of the system object of the invention in the panels (7) of the doors.

Having sufficiently described the nature of this invention patent, it must only be added that the invention can undergo certain variations in shape and materials such that said alterations do not substantially modify the features claimed below.

The invention claimed is:

1. A synchronized actuation system for sliding doors, comprising:

a free grip and a pulling grip joined to panels of the doors, wherein a transmission belt enables movement of the grips on a guide, wherein the pulling grip and the free grip have flanges and the transmission belt and pulling grip are joined by a connecting shoe formed by a base that is separate from structure of the pulling grip, the base defining at least one fastener hole arranged for receiving at least one threaded fastener that joins the shoe and the pulling grip, wherein the flange of the pulling grip defines at least one engagement hole arranged to receive an engagement member extending between the shoe and the transmission belt, and wherein a wall extends vertically from the base and an upper cover emerges from the wall, leaving a gap through which the transmission belt passes and is trapped by the engagement member between the cover and an intermediate base.

* * * * *